US009656380B2

(12) United States Patent
Monroy et al.

(10) Patent No.: US 9,656,380 B2
(45) Date of Patent: May 23, 2017

(54) POWER TOOL WITH ACCESSORY CHANGE TOOL STORAGE

(71) Applicants: Robert Bosch Tool Corporation, Broadview, IL (US); Robert Bosch GmbH, Stuttgart (DE)

(72) Inventors: Agustin Monroy, Bellavista Mexicali (MX); Jaime Moreno, Imperial, CA (US); Edward Pchola, Mount Prospect, IL (US); Daniel Shadegg, Buffalo Grove, IL (US); Saad Alam, Franklin Park, IL (US); Dale Selsor Di Iulio, Saukville, WI (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 460 days.

(21) Appl. No.: 14/472,705

(22) Filed: Aug. 29, 2014

(65) Prior Publication Data

US 2015/0060100 A1 Mar. 5, 2015

Related U.S. Application Data

(60) Provisional application No. 61/872,030, filed on Aug. 30, 2013.

(51) Int. Cl.
*E21B 3/00* (2006.01)
*E21B 17/22* (2006.01)
(Continued)

(52) U.S. Cl.
CPC ..... *B25F 5/029* (2013.01); *B25F 3/00* (2013.01)

(58) Field of Classification Search
CPC ..... B25F 5/00; B25F 5/029; B25F 3/00
(Continued)

(56) References Cited

U.S. PATENT DOCUMENTS 4,751,970 A * 6/1988 Hecker ..... B23B 45/003 173/104
5,029,706 A 7/1991 McCracken
(Continued)

FOREIGN PATENT DOCUMENTS

WO WO2009123529 A1 10/2009
WO 2012065789 A1 5/2012

OTHER PUBLICATIONS

International Search Report and Written Opinion corresponding to PCT Application No. PCT/US2014/053480, mailed Nov. 25, 2014 (9 pages).

*Primary Examiner* — Robert Long
(74) *Attorney, Agent, or Firm* — Maginot Moore & Beck LLP

(57) ABSTRACT

A power tool includes a housing in which a motor is supported and an output shaft coupled to the motor that extends from the housing. A tool holder is secured to the end portion of the output shaft which is configured to releasably retain an accessory tool. The power tool includes an accessory change tool having a driver portion and a handle portion. The driver portion is used to install and remove the accessory change tool from the tool holder. The handle portion and the driver portion are configured to pivot into a folded position at which the handle portion is located adjacent the driver portion. A retainer assembly is incorporated into the housing that is configured to releasably retain the accessory change tool on the housing with the accessory change tool in the folded configuration.

20 Claims, 2 Drawing Sheets

(51) Int. Cl.
*E21B 19/16* (2006.01)
*E21B 19/18* (2006.01)
*B25F 5/02* (2006.01)
*B25F 3/00* (2006.01)

(58) Field of Classification Search
USPC ..... 173/49, 100, 110, 213, 170–171; 451/356–357; 74/20–25
See application file for complete search history.

(56) References Cited

U.S. PATENT DOCUMENTS 5,149,230 A 9/1992 Nett
5,771,516 A * 6/1998 Huang ..... B25F 3/00 254/122
5,833,524 A * 11/1998 Satoh ..... B24B 55/105 285/184
6,357,336 B1 * 3/2002 Wittmann ..... F16C 19/54 74/60
7,600,579 B2 10/2009 Wasielewski
8,109,344 B1 2/2012 Hays
2009/0320625 A1 * 12/2009 Kildevaeld ..... B23D 51/10 74/25
2011/0000690 A1 * 1/2011 Kildevaeld ..... B23D 51/10 173/29
2011/0011605 A1 * 1/2011 Kildevaeld ..... B23D 51/10 173/1
2011/0036609 A1 * 2/2011 Blickle ..... B24B 23/028 173/213
2011/0209888 A1 * 9/2011 Elsworthy ..... B23B 31/1071 173/217
2011/0220378 A1 * 9/2011 Numata ..... B24B 23/028 173/141
2013/0126198 A1 * 5/2013 Campbell ..... B25F 5/003 173/31

* cited by examiner

POWER TOOL WITH ACCESSORY CHANGE TOOL STORAGE

CROSS-REFERENCE TO RELATED APPLICATIONS

This application claims priority to U.S. Provisional Application Ser. No. 61/872,030 entitled " POWER TOOL WITH ACCESSORY CHANGE TOOL STORAGE" by Monroy et al., filed Aug. 30, 2013, the disclosure of which is hereby incorporated herein by reference in its entirety.

TECHNICAL FIELD

The disclosure relates generally to power tools, and, in particular, to power tools having accessory change tools.

BACKGROUND

Power tools typically are configured to utilize various accessories and attachments to perform work. For example, oscillating power tools are configured to oscillate various accessories, such as cutting blades, sanding discs, grinding tools, and many others. The accessory tools are retained on the tool by a fastening mechanism, such as a clamping screw or bolt. A separate accessory change tool, such as a driver or wrench, is typically required to manipulate the fastening mechanism so accessory tools can be installed and removed from the tool. While this system is cost effective, the accessory change tool is often separated from the power tool and can be difficult to locate at times and easily misplaced or lost.

DRAWINGS

DETAILED DESCRIPTION

Figure 1:
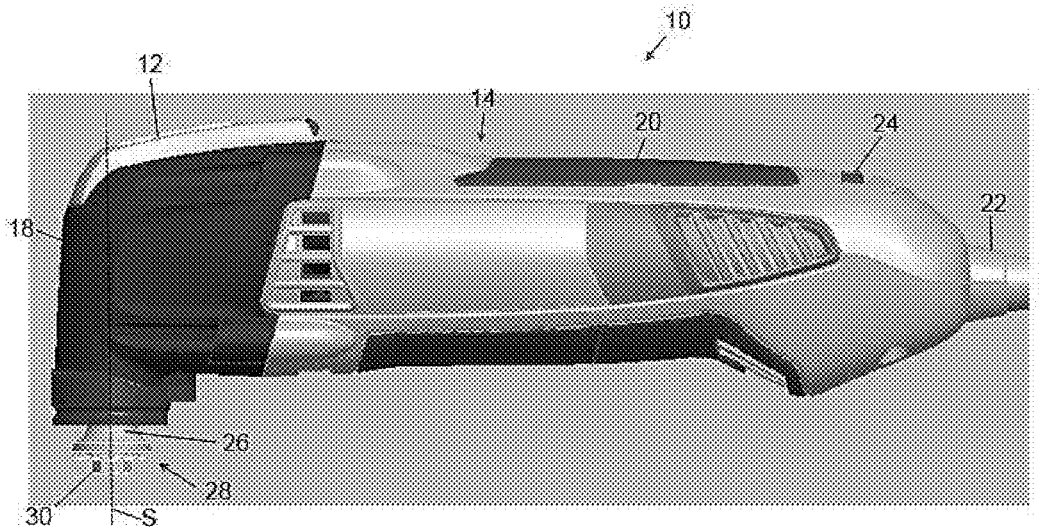
FIG. 1 depicts an embodiment of a power tool with an integrate accessory change tool.

For the purposes of promoting an understanding of the principles of the disclosure, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one of ordinary skill in the art to which this disclosure pertains.

In accordance with the disclosure, a power tool is provided with an accessory change tool that is integrated into and stored on the housing of the tool so that it is always accessible and is stored in a manner that does not interfere with the operation or aesthetics of the tool. Such a power tool includes a housing having a generally cylindrical main body portion and a nose portion. A motor is supported in the main body portion of the housing. An output shaft is coupled to the motor and has an end portion that extends from the nose portion of the housing. A tool holder is secured to the end portion of the output shaft. The tool holder includes a fastener member. The fastener member includes a drive structure and is configured to move between a first position and a second position with respect to the tool holder. The fastener member is configured to allow an accessory tool to be installed and removed from the tool holder when at the first position and to fixedly secure an accessory tool to the tool holder when at the second position. In one embodiment, the power tool comprises an oscillating power tool in which the motor is configured to oscillate the output shaft. In alternative embodiments, the power tool may comprise other types of portable power tools including, for example, drills, drivers, saws, routers, and the like.

The power tool includes an accessory change tool having a driver portion and a handle portion. The driver portion is pivotably connected to the handle portion and includes a drive structure that is configured complementary to the drive structure of the fastener member. The handle portion and the driver portion are configured to pivot with respect to each other between a folded configuration and a deployed configuration. In the deployed configuration, the handle portion extends outwardly from the driver portion to facilitate grasping of the handle portion by a user. In the folded configuration, the handle portion is positioned adjacent the driver portion. The power tool includes a retainer assembly incorporated into the housing that is configured to releasably retain the accessory change tool on the housing with the accessory change tool in the folded configuration.

According to the disclosure, the accessory change tool may have an inner side portion that is configured to be positioned adjacent the housing and an inner side portion that is configured to face away from the housing when the accessory change tool is retained by the retaining assembly. The retainer assembly defines a pocket that is configured to receive at least the inner side portion of the accessory change tool. The outer side portion of the accessory change tool has an outer surface that has a contoured shape that follows a contour of the outer surface of the housing when the inner side portion of the accessory tool is positioned within the recess.

In one embodiment, the retainer assembly includes a bottom surface and side walls that are arranged to form an open ended channel that leads into the pocket. The accessory change tool is configured to slide longitudinally into the channel. The accessory change tool includes a hinge portion at which the handle portion and the driver portion pivotably connected with the handle portion and the driver portion each including an outer end portion located distally from the hinge portion. In one embodiment, the accessory change tool in the folded configuration is inserted into the channel with the outer end portions of the accessory change tool entering the channel first and the hinge portion of the accessory change tool entering last.

The side walls and bottom surface of the retainer assembly may define a partially undercut cross-sectional shape for the channel, such as a dovetail or T-shaped groove. In this case, the inner side portion of the accessory change tool may be shaped complementary in cross-section to the undercut cross-sectional shape of the channel to prevent movement of the accessory change tool out of the channel in directions transverse to the axis of the channel.

The retainer assembly may include a retaining mechanism that is configured to releasably retain the accessory change tool within the pocket. The channel may be configured to guide the accessory change tool to a seated position within the channel in which case the retaining mechanism may be configured to releasably retain the accessory change tool within the channel in the seated position.

The retaining mechanism may include a driver retaining portion that is arranged within the pocket at an inner end of the channel and is configured to engage the driver portion when the accessory change tool is in the seated position in the channel. In one embodiment, the driver portion comprises a geometrically-shaped recess, such as a hexagonally-shaped recess, which is configured to drive a complementarily shaped head of a fastener member. In this embodiment, the driver retaining portion may a protrusion configured to have a friction fit within the geometrically-shaped recess when the accessory change tool is in the seated position.

The retaining mechanism may include a handle retaining portion in addition to or as an alternative to a driver retaining portion. The handle retaining portion is configured to engage the handle portion of the accessory change tool to releasably retain the accessory change tool in the seated position. In this embodiment, the handle portion and the handle retaining portion may include detent structures which are configured to move into a blocking position with respect to each other when the accessory change tool is in the seated position. In one embodiment, the detent structure of the handle portion comprises an opening, and the detent structure of the handle retaining portion comprises a protrusion positioned to be received in the opening when the accessory change tool is in the seated position.

The retaining mechanism may comprise a flexible arm member that is positioned and configured to be flexed by the accessory change tool as the accessory change tool is slid into the channel toward the seated position. In this embodiment, the detent structure of the handle retaining portion is located at a position on the flexible arm member where the detent structure can be received in the opening when the accessory change tool reaches the seated position. The flexing of the flexible arm may be used to bias the detent structure into the opening and hold the detent structure in a blocking position with respect to the opening. The detent structure of the handle retaining portion is accessible via the opening and can be pressed downwardly by a user of the tool to disengage the detent from the opening so the accessory change tool can be removed from the channel.

In one embodiment, the retaining mechanism includes both a handle retaining portion and a driver retaining portion. The driver retaining portion may be incorporated onto the flexible arm member at a second position which is located at the inner end of the channel.

Referring now to the drawings, FIG. 1 depicts an embodiment of a power tool 10 having an integrated accessory change tool 12 in accordance with the disclosure. In the embodiment of FIG. 1, the power tool 10 comprises an oscillating power tool that is configured to oscillate various accessories and attachments, such as cutting blades, sanding discs, grinding tools, and many others (not shown). The oscillating tool 10 includes a generally cylindrically shaped housing 14 constructed of a rigid material such as plastic, metal, or composite materials such as a fiber reinforced polymer.

The housing 14 includes a nose portion 18 and a main body portion 20. The main body portion 20 serves as the handle for the tool 10 and encloses a motor (not shown). In one embodiment, the motor comprises an electric motor configured to receive power from an AC outlet via a power cord 22. In other embodiments, electric power for the motor may be received from a rechargeable battery (not shown) connected at the base of the main body portion 20. Power to the tool is controlled by a power switch 24 provided on the main body portion 20 of the housing 14.

The tool 10 includes an output shaft 26 that is configured to be oscillated about an oscillation axis S by the motor at high frequencies, e.g., 5,000 to 25,000 oscillations per minute, with a small oscillating angle, typically in a range of between 0.5° and 7°. Other frequencies higher than 25,000 oscillations per minute with oscillating angle below 0.5° or above 7° is possible. The output shaft 26 supports an accessory tool holder 28 exterior to the nose portion 18 of the housing 14. The tool holder 28 is configured to releasably secure various accessory tools to the output shaft 26, such as a cutting blade accessory tool (not shown). As the tool holder 28 is oscillated by the output shaft 26, the accessory tool is driven to oscillate about the axis S. To enable a secure connection between the tool holder 28 and accessory tools for use with the power tool 10, the tool holder 28 and associated accessory tools may be provided with interlocking drive structures that mate to secure the accessory tool to the tool holder 28.

A fastener structure 30, such as a clamping screw or bolt, is used to press the mounting portion of an accessory tool (not shown) into engagement with the tool drive structure on the tool holder 28. The fastener structure 30 has a configuration that enables the fastener structure to be turned or rotated by a complementarily configured driver incorporated into the accessory change tool. In the embodiment of FIG. 1, the fastener structure 30 has a head with a keyed outer shape, such as a hexagonal-shaped head, of a particular size. Other geometry shaped head and sizes are also possible. In this embodiment, the driver portion 34 (FIG. 3) of the accessory change tool 12 comprises a wrench with a complementarily sized and shaped recess 36, such as a hexagonal-shaped recess although other geometry and/or sizes of recesses may be used.

Figure 2:
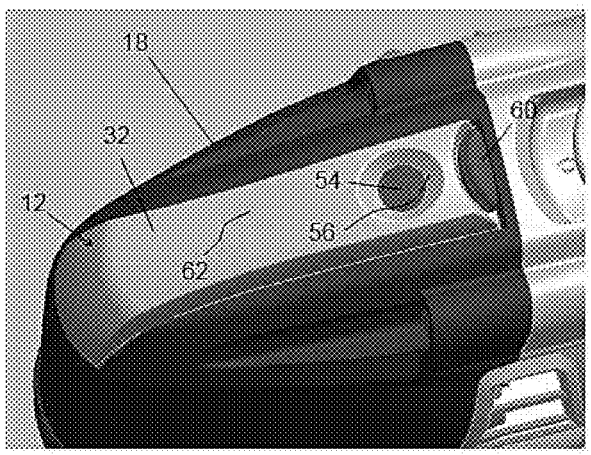
FIG. 2 is a perspective view of the nose portion of the power tool of FIG. 1 showing the accessory change tool.

The accessory change tool 12 is used by an operator of the tool to manipulate the fastener structure 30 so that accessories can be removed and installed on the tool as needed. The accessory change tool 12 and the power tool housing 14 are configured to cooperate to removably secure the accessory change tool 12 on the power tool 10 when it is not needed as depicted in FIG. 2 while allowing the accessory change tool 12 to be easily and conveniently removed from the power tool for installing and removing accessories on the tool.

Figure 3:
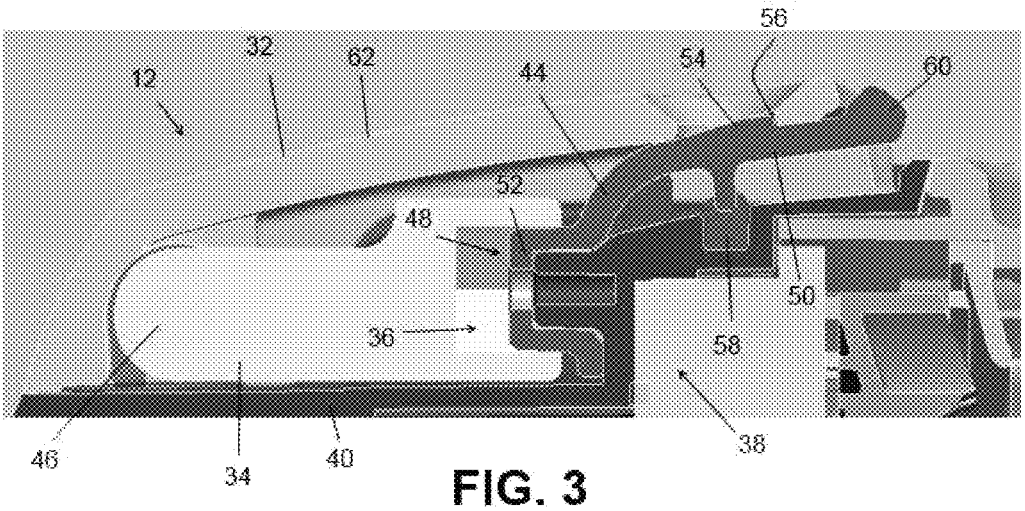
FIG. 3 is a cross-sectional view of the nose portion of the power tool and the accessory change tool of FIG. 1.

Referring to FIG. 3, the accessory change tool 12 includes a driver portion 34 that is pivotably attached to a handle portion 32. The driver portion 34 includes a drive structure which in this embodiment comprises a hexagonally shaped recess 36. As depicted in FIG. 3, the driver portion 34 is configured to pivot into a storage position at which the driver portion 34 lies adjacent to the handle portion 32. When folded in this manner, the size of the accessory change tool 12 is minimized so it can be more easily retained on the tool 10 without substantially impacting the profile or cosmetic appearance of the tool 10.

The power tool includes a retainer assembly 38 for the accessory change tool 12. The retainer assembly 38 is located in a suitable position on the tool that can accommodate the change tool 12 at a location for quick and easy access by the operator. In embodiment of FIGS. 1-5, the retainer assembly 38 for the accessory change tool 12 is incorporated into the nose portion 18 of the housing 14. The retainer assembly 38 may be positioned at other locations on power tools depending on the type of power tool, the shape of the housing, and the configuration of the change tool.

The retainer assembly 38 includes a generally planar bottom surface 40 and a pair of side walls 42 that form a pocket that is sized and shaped complementary to the accessory change tool 12. The bottom surface 40 and side walls 42 may be integrated into the nose portion 18 of the housing by molding the shapes into the housing shells. The bottom surface 40 and side walls 42 are configured to form a channel structure for guiding the accessory change tool into and out of the pocket. The channel structure is open toward the front of the tool 10 to provide a path into and out of the pocket for change tool.

A retaining mechanism 44 is provided in the pocket at the other end of the channel that is configured to releasably retain the accessory change tool 12. The accessory change tool 12 is inserted into the pocket with the driver portion 34 oriented toward the bottom surface 40 of the retainer assembly 38 and the handle portion 32 oriented away from the bottom surface. The change tool 12 is configured to inserted into the pocket via the open end of the channel structure with the outer ends of the handle portion 32 and the driver portion 34 oriented toward the rear of the tool 10 and the hinge portion 46 oriented toward the front of the tool 10.

The driver portion 34 of the accessory change tool 12 has a smooth outer surface with a suitable contour, e.g., flat, curved, arced, and the like, that is capable of sliding along the planar bottom surface 40 when being inserted into and removed from the pocket. The side walls 42 of the pocket and the side surfaces of the handle portion 32 are configured to cooperate to limit movement of the accessory change tool 12 in directions that are transverse to the direction of insertion and removal.

Figure 4:
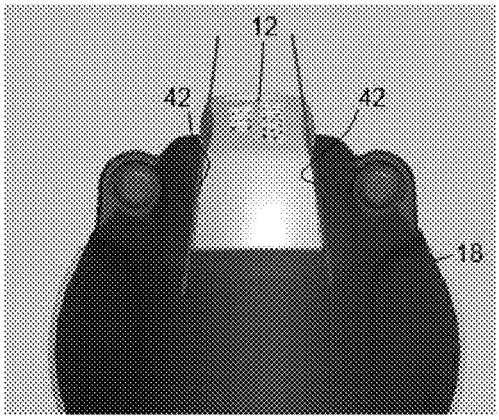
FIG. 4 is front view of the nose portion of the power tool showing the dovetail configuration of the retaining structure on the power tool and the accessory change tool.

In the embodiment of FIGS. 1-5, the side walls 42 of the pocket and the side surfaces of the handle portion 32 of the change tool 12 are provided with complementary dovetail configurations. As can be seen in FIG. 4, the side walls 42 are angled toward each other in the vertical dimension so that the side walls 42 are spaced farther apart from each other near the bottom surface 40 than they are near the tops of the side walls 42. The side surfaces of the handle portion 32 are shaped complementarily to the side walls 42 so that, when the accessory change tool 12 is inserted between the side walls 42 through the open end of the channel, the side walls 42 can prevent upward movement of the accessory change tool 12 out of pocket. The side walls 42 also serve to maintain the accessory change tool 12 in a folded position in the pocket.

Figure 5:
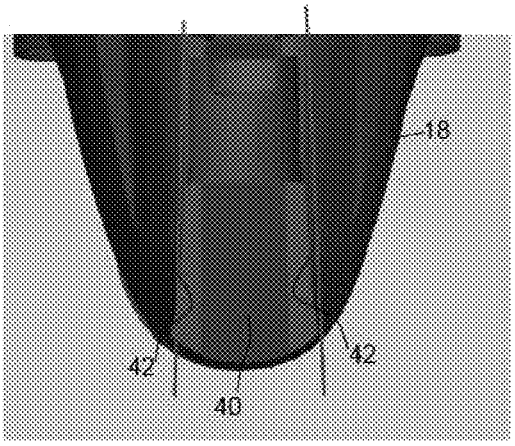
FIG. 5 is a top view of the nose portion of the power tool showing the angled shape of the side walls of the retaining structure on the power tool.

The side walls 42 are also angled with respect to each in the horizontal dimension. As can be seen in FIG. 5, the side walls 42 are angled closer to each other as they approach the retaining mechanism from the insertion end of the channel. The handle portion 32 of the change tool 12 is shaped complementary to the side walls 42 with the handle portion 32 being wider near the hinge portion 46 and tapering toward the end of the handle portion 32. This facilitates insertion of the accessory change tool 12 into the pocket as the narrow portion 3 of the handle is inserted into the wide portion of the channel first. The side walls 42 constrict against the side surfaces of the change tool 12 as the tool 12 is advanced into the pocket to provide a tight fit for securely retaining the change tool 12.

The retaining mechanism 44 includes a driver retaining portion 48 and a handle retaining portion 50. The driver retaining portion 48 comprises a projection 52 that is sized and positioned complementary to the recess 36 in the driver portion 34 of the change tool 12. The accessory change tool 12 is guided into the pocket by the side walls 42 until the projection 52 is received in the recess 36. The projection 52 is sized to snugly fit into the recess 36 to facilitate retention of the accessory change tool 12 in the pocket. In one embodiment, the projection 52 may be configured to have a friction fit or snap fit engagement with the recess.

The handle retaining portion 50 of the retaining mechanism 44 includes a detent structure 54 that is configured to engage a complementarily configured detent structure 56 on the handle portion 32 of the accessory change tool 12. In the embodiment of FIG. 3, the detent structure 54 comprises a bump and the detent structure 56 comprises an opening. The bump 54 on the retaining mechanism 44 is positioned to be received in the opening 56 on the handle portion 32 of the change tool 12 when the change tool 12 is inserted completely into the pocket.

The handle retaining portion 50 is biased into an upward position to bring the bump 54 into engagement with the opening 56 in the handle portion 32 by a biasing member 58. To release the accessory change tool 12 from the pocket, the retaining mechanism 44 includes an end portion 60 that projects past the end of the handle portion 32 and serves as a push button release mechanism. An operator of the tool 10 can press down on the end of the retaining mechanism 44 to move the bump 54 out of engagement with the opening 56 so that the accessory change tool 12 can be slid out of the pocket.

In one embodiment, the retaining mechanism 44 comprises a plastic clip that is secured to the power tool housing by a fastener, such as a screw. As can be seen in FIGS. 2 and 3, the outer surface 62 of the handle portion 32 of the accessory change tool 12 is provided with a contoured shape that matches the contour and shape of the housing 18 at the storage position. This enables the accessory change tool 12 to be stored on the power tool 10 without interfering with the use or impacting the cosmetic aspect of the tool. The plastic clip is one of many possible configurations for retaining the accessory change tool 12 on the housing of the tool. In alternative embodiments, the retaining mechanism can be provided in a variety of different shapes, sizes, and materials and be configured to retain the accessory change tool 12 using other methods, such as detents, friction fit engagement, quick release mechanism, and the like.

Although the above description is directed to an oscillating power tool, a similar accessory change tool storage system may be incorporated into other types of power tools to integrate an accessory change tool for the power tool into the power tool housing. For example, an accessory change tool storage system such as described above may be incorporated into rotary power tools, drills, drivers, jig saws, circular saws, and other tools that require the use of a separate tool or wrench for installing and removing accessories from the tool.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A power tool comprising:

a housing including a generally cylindrical main body portion and a nose portion;

a motor supported in the main body portion of the housing;

an output shaft coupled to the motor and having an end portion that extends from the nose portion of the housing;

a tool holder secured to the end portion of the output shaft, the tool holder including a fastener member, the fastener member including a drive structure and being configured to move between a first position and a second position with respect to the tool holder, the fastener member being configured to allow an accessory tool to be installed and removed from the tool holder when at the first position and to fixedly secure an accessory tool to the tool holder when at the second position;

an accessory change tool including a driver portion and a handle portion, the driver portion being pivotably connected to the handle portion and including a drive structure that is configured complementary to the drive structure of the fastener member, the handle portion and the driver portion being configured to pivot with respect to each other between a folded configuration and a deployed configuration, in the deployed configuration, the handle portion extends outwardly from the driver portion to facilitate grasping of the handle portion by a user, in the folded configuration, the handle portion is positioned adjacent the driver portion; and a retainer assembly incorporated into the housing and configured to releasably retain the accessory change tool on the housing with the accessory change tool in the folded configuration.

2. The power tool of claim 1, wherein, in the folded configuration, the accessory change tool has an inner side portion that is configured to be positioned adjacent the housing and an inner side portion that is configured to face away from the housing when the accessory change tool is retained by the retaining assembly, wherein the retainer assembly defines a pocket that is configured to receive at least the inner side portion of the accessory change tool, and wherein the outer side portion has an outer surface that has a contoured shape that follows a contour of the outer surface of the housing when the inner side portion of the accessory tool is positioned within the recess.

3. The power tool of claim 2, wherein the retainer assembly includes a retaining mechanism that is configured to releasably retain the accessory change tool within the pocket.

4. The power tool of claim 3, wherein the retainer assembly includes a bottom surface and side walls that are arranged to form an open ended channel that leads into the pocket, wherein, in the folded configuration, the accessory change tool has a generally longitudinal shape with a first end portion and a second end portion, and wherein the accessory change tool is configured to slide longitudinally into the channel with the first end portion arranged facing into the channel and the second end portion arranged facing out of the channel.

5. The power tool of claim 4, wherein the accessory change tool includes a hinge portion at which the handle portion and the driver portion pivotably connected, the handle portion and the driver portion each including an outer end portion located distally from the hinge portion, and wherein the hinge portion of the accessory change tool forms the second end portion in the folded configuration and the outer end portions of the handle portion and the driver portion form the first end portion when the accessory change tool is in the folded configuration.

6. The power tool of claim 5, wherein the side walls and bottom surface of the retainer assembly define a partially undercut cross-sectional shape for the channel, and wherein the inner side portion of the accessory change tool is shaped complementary in cross-section to the undercut cross-sectional shape of the channel so that movement of the accessory change tool in directions transverse to the channel axis is prevented while the accessory change tool is positioned within the channel.

7. The power tool of claim 6, wherein the channel is configured to guide the accessory change tool to a seated position within the channel, wherein the retaining mechanism is configured to releasably retain the accessory change tool within the channel in the seated position.

8. The power tool of claim 7, wherein the retaining mechanism includes a driver retaining portion, the driver retaining portion being arranged within the pocket at an inner end of the channel and is configured to interlock with the drive structure of the driver portion when the accessory change tool is in the seated position in the channel to releasably retain the accessory change tool in the seated position.

9. The power tool of claim 8, wherein the drive structure of the driver portion of the accessory change tool comprises a geometrically-shaped recess, and wherein the driver retaining portion comprises a protrusion configured to have a friction fit within the geometrically-shaped recess when the accessory change tool is in the seated position.

10. The power tool of claim 7, wherein the retaining mechanism includes a handle retaining portion, the handle retaining portion being configured to engage the handle portion of the accessory change tool to releasably retain the accessory change tool in the seated position.

11. The power tool of claim 10, wherein the handle portion and the handle retaining portion include detent structures which are configured to move into a blocking position with respect to each other when the accessory change tool is in the seated position.

12. The power tool of claim 11, wherein the detent structure of the handle portion comprises an opening, and wherein the detent structure of the handle retaining portion comprises a protrusion positioned to be received in the opening when the accessory change tool is in the seated position.

13. The power tool of claim 12, wherein the retaining mechanism comprises a flexible arm member, wherein the arm member is configured to be flexed by the accessory change tool as the accessory change tool is slid into the channel toward the seated position, wherein the detent structure of the handle retaining portion is located at a first position on the flexible arm member where the detent structure can be received in the opening when the accessory change tool reaches the seated position, the flexible arm member biasing the detent structure into the opening.

14. The power tool of claim 13, wherein the retaining mechanism includes a driver retaining portion, the driver retaining portion being located at a second position on the flexible arm that is located within the pocket at an inner end of the channel, the driver retaining portion being configured to interlock with the drive structure of the driver portion when the accessory change tool is in the seated position in the channel to releasably retain the accessory change tool in the seated position.

15. The power tool of claim 1, wherein the output shaft is configured to be oscillated by the motor.

16. A power tool comprising:

a housing including a generally cylindrical main body portion and a nose portion;

a motor supported in the main body portion of the housing;

an output shaft coupled to the motor and having an end portion that extends from the nose portion of the housing;

a tool holder secured to the end portion of the output shaft, the tool holder configured to releasably retain an accessory tool;

an accessory change tool including a driver portion and a handle portion, the driver portion being configured to install the accessory change tool onto and remove the accessory change tool from the tool holder, the handle portion and the driver portion being configured to pivot with respect to each other between a folded configuration and a deployed configuration, in the deployed configuration, the handle portion extends outwardly from the driver portion to facilitate grasping of the handle portion by a user, in the folded configuration, the handle portion is positioned adjacent the driver portion; and a retainer assembly incorporated into the housing and configured to releasably retain the accessory change tool on the housing with the accessory change tool in the folded configuration.

17. The power tool of claim 16, wherein the retainer assembly that is configured to receive the accessory change tool in the folded configuration, wherein the accessory change tool is configured to be inserted into the pocket in the folded configuration with the driver portion arranged proximate the housing and the handle portion positioned on an opposite side of the driver portion from the housing.

18. The power tool of claim 17, wherein the handle portion has an outer surface that faces outwardly from the housing, wherein the outer surface is positioned proximate an outer surface of the housing when the accessory change tool is positioned within the pocket, and wherein the handle portion is shaped such that a contour of the outer surface follows a contour of the outer surface of the housing.

19. The power tool of claim 18, wherein the retainer assembly defines a channel configured to allow the accessory change tool to be slid longitudinally into the pocket, and wherein the retainer assembly includes a detent that is biased into a blocking position with respect to an opening in the handle portion of the accessory change tool when the accessory change tool is received within the pocket.

20. The power tool of claim 19, wherein the detent is configured to be pressed downwardly to disengage the detent from the opening so the accessory change tool can be removed from the channel.

* * * * *